US007396394B2

(12) United States Patent
Aiba et al.

(10) Patent No.: US 7,396,394 B2
(45) Date of Patent: Jul. 8, 2008

(54) ELECTROLESS GOLD PLATING SOLUTION

(75) Inventors: Akihiro Aiba, Kitaibaraki (JP); Kazumi Kawamura, Kitaibaraki (JP); Hirofumi Takahashi, Kitaibaraki (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 6 days.

(21) Appl. No.: 11/632,815

(22) PCT Filed: Aug. 22, 2005

(86) PCT No.: PCT/JP2005/015229

§ 371 (c)(1),
(2), (4) Date: Jan. 18, 2007

(87) PCT Pub. No.: WO2006/051637

PCT Pub. Date: May 18, 2006

(65) Prior Publication Data

US 2007/0209548 A1 Sep. 13, 2007

(30) Foreign Application Priority Data

Nov. 15, 2004 (JP) ..... 2004-330036

(51) Int. Cl.
*C23C 18/42* (2006.01)

(52) U.S. Cl. ..... 106/1.23; 106/1.26

(58) Field of Classification Search ..... 106/1.23, 106/1.26; 428/457
See application file for complete search history.

(56) References Cited

U.S. PATENT DOCUMENTS

| | | | | |
|---|---|---|---|---|
| 3,300,328 | A * | 1/1967 | Luce | 106/1.26 |
| 4,804,559 | A * | 2/1989 | Ushio et al. | 106/1.26 |
| 5,232,492 | A * | 8/1993 | Krulik et al. | 106/1.23 |
| 5,318,621 | A * | 6/1994 | Krulik et al. | 106/1.23 |
| 5,470,381 | A * | 11/1995 | Kato et al. | 106/1.23 |
| 5,935,306 | A * | 8/1999 | Reed | 106/1.23 |
| 6,767,392 | B2 * | 7/2004 | Hayashi et al. | 106/1.23 |
| 6,897,135 | B2 * | 5/2005 | Izumi et al. | 438/597 |
| 2006/0230979 | A1 * | 10/2006 | Aiba et al. | 106/1.23 |
| 2006/0269761 | A1 * | 11/2006 | Aiba et al. | 106/1.23 |

FOREIGN PATENT DOCUMENTS

| | | |
|---|---|---|
| JP | 8-291389 | 11/1996 |
| JP | 10-317157 | 12/1998 |
| JP | 3030113 | 2/2000 |
| JP | 2003-13249 | 1/2003 |
| JP | 2004-137589 | 5/2004 |
| JP | 2004-250765 | 9/2004 |

* cited by examiner

*Primary Examiner*—Helene Klemanski
(74) *Attorney, Agent, or Firm*—Flynn, Thiel, Boutell & Tanis, P.C.

(57) ABSTRACT

The invention provides a displacement electroless gold plating solution that is low in toxicity, can be used at a pH near to neutrality, and affords good solder adhesion and film adhesion. The displacement electroless gold plating solution contains a non-cyanide water-soluble gold compound and a hydrogensulfite compound. Preferably, the plating solution further contains a thiosulfuric acid compound or an aminocarboxylic acid compound. Sodium hydrogensulfite, potassium hydrogensulfite, ammonium hydrogensulfite or the like can be used as the hydrogensulfite compound.

3 Claims, No Drawings

ELECTROLESS GOLD PLATING SOLUTION

TECHNICAL FIELD

The present invention relates to a plating technology, and more particularly to a non-cyanide displacement electroless gold plating solution.

BACKGROUND ART

Displacement electroless gold plating solutions have been used to form an intermediate layer in an effort to improve the solder adhesion of circuits, terminals, and so forth in printed wiring boards, and to improve the adhesion of reductive gold plating and the like. Most of the gold plating solutions used for this purpose contain a toxic cyanide compound as a gold compound, but concerns for the environment and the workplace require non-cyanide gold plating solutions that do not contain toxic substances.

Patent applications that have been filed for non-cyanide displacement electroless gold plating solutions include those that make use of gold sulfite compounds (see, for example, Patent Documents 1 and 2), those that make use of gold sulfites or chloroaurates (see, for example, Patent Document 3), and those that make use of gold sulfite, gold chloride, gold thiosulfate, or gold mercaptocarboxylates (see, for example, Patent Document 4). Although the electroless gold plating solutions discussed in these publications are cyanide-free, i.e. low in toxicity, and can be used close to neutral conditions, their inferior solder adhesion and film adhesion remain a problem. "Film adhesion" refers to adhesion between a displacement electroless gold plating film and a substrate and, when a displacement electroless gold plating film is used as an intermediate layer, refers to the adhesion to the layers above and below the film.

Patent Document 1: Japanese Patent No. 3,030,113

Patent Document 2: Japanese Patent Publication No. 2003-13249A

Patent Document 3: Japanese Patent Publication No. 8-291389A

Patent Document 4: Japanese Patent Publication No. 10-317157A

DISCLOSURE OF THE INVENTION

Problems that the Invention is to Solve

In light of the above situation, it is an object of the present invention to provide a non-cyanide displacement electroless gold plating solution that is low in toxicity, can be used near neutral conditions, and affords good-solder adhesion and film adhesion.

Means for Solving the Problems

As a result of research into the causes that have an adverse influence on film adhesion and solder adhesion of a displacement electroless gold plating film, the inventors found that the problem is non-uniform displacement of the underlying metal plating film, such as an underlying nickel film. More specifically, solder adhesion and film adhesion were poor in the case that non-uniform corrosion marks such as pitting were seen on an underlying nickel film after a gold plating film had been stripped off, because defects of some kind were also present in a displacement electroless gold plating film. Conversely, when there were no non-uniform corrosion marks, solder adhesion and film adhesion were good.

Therefore, the inventors researched bath compositions that would not result in non-uniform corrosion marks in the underlying nickel film after stripping the gold film off, and as a result discovered that it is effective to add a hydrogensulfite compound, which enables a gold plating film to have good solder adhesion and film adhesion.

Specifically, according to the present invention there are provided:

(1) A displacement electroless gold plating solution, containing a non-cyanide water-soluble gold compound and a hydrogensulfite compound.

(2) The displacement electroless gold plating solution according to (1) above, further containing a thiosulfuric acid compound.

(3) The displacement electroless gold plating solution according to (1) or (2) above, further containing an aminocarboxylic acid compound.

(4) A gold plated article, produced using the displacement electroless gold plating solution according to any one of (1) to (3) above.

There are no particular restrictions on the non-cyanide water-soluble gold compound used in the plating solution of the present invention, as long as it is cyanide-free and water-soluble, but it is characterized by containing a hydrogensulfite compound as an additive.

Effects of the Invention

The invention allows providing a non-cyanide displacement electroless gold plating solution that is low in toxicity, can be used at a pH near to neutrality, and affords good solder adhesion and film adhesion. In particular, the invention allows realizing a non-cyanide displacement electroless gold plating solution that can enhance the low adhesive strength to lead-free solders.

BEST MODE FOR CARRYING OUT THE INVENTION

The displacement electroless gold plating solution of the present invention will now be described in detail. The electroless gold plating solution of the present invention is an aqueous solution comprising a non-cyanide water-soluble gold compound and a hydrogensulfite compound.

There are no particular restrictions on the non-cyanide water-soluble gold compound as long as it is a non-cyanide gold compound, but it is preferable to use gold sulfite, gold thiosulfate, gold thiocyanate, chloroauric acid, or a salt thereof. The electroless gold plating solution of the present invention preferably contains these gold compounds in an amount of 0.1 to 100 g/L, and more preferably 0.5 to 20 g/L, as the gold concentration in the plating solution. The displacement rate by gold is very small if the gold concentration is less than 0.1 g/L, while on account of saturation there is no further advantage in exceeding 100 g/L.

As the hydrogensulfite compound can be used a hydrogensulfite salt, such as an alkali metal salt, an alkaline earth metal salt, an ammonium salt or the like, preferably sodium hydrogensulfite, potassium hydrogensulfite, ammonium hydrogensulfite or the like. The hydrogensulfite compound is preferably contained in the plating solution in an amount of 0.1 to 400 g/L, and more preferably 5 to 200 g/L. The effect of preventing non-uniform corrosion of the underlying nickel is weak if the hydrogensulfite concentration is less than 0.1 g/L, while on account of saturation there is no further advantage in exceeding 400 g/L.

The electroless gold plating solution of the present invention preferably contains a thiosulfuric acid compound. The presence of a thiosulfuric acid compound has the effect of enhancing solder adhesion of the obtained plating film. As the thiosulfuric acid compound can be used, for instance, an alkali metal salt, an alkaline earth metal salt, an ammonium salt or the like of thiosulfuric acid, preferably sodium thiosulfate, potassium thiosulfate, ammonium thiosulfate or the like. The content of thiosulfuric acid compound in the plating solution is preferably from 1 mg/L to 10 g/L, more preferably from 10 to 1000 mg/L. A concentration of thiosulfuric acid compound below 1 mg/L results in a small enhancement effect on solder adhesive strength, while on account of saturation there is no further advantage in exceeding 10 g/L.

The gold plating solution of the present invention may further contain an aminocarboxylic acid compound as a complexing agent. Examples of aminocarboxylic acid compounds include ethylenediaminetetraacetic acid, hydroxyethylethylenediaminetriacetic acid, dihydroxyethylethylenediaminediacetic acid, propanediaminetetraacetic acid, diethylenetriaminepentaacetic acid, triethylenetetraminehexaacetic acid, glycine, glycylglycine, glycylglycylglycine, dihydroxyethylglycine, iminodiacetic acid, hydroxyethyliminodiacetic acid, nitrilotriacetic acid, nitrilotripropionic acid, as well as salts thereof such as alkali metal salt, alkaline earth metal salt, ammonium salt, etc. The concentration of the aminocarboxylic acid compound in the plating solution is preferably from 0.1 to 200 g/L, and more preferably 1 to 100 g/L. The effect as a complexing agent is weak if the aminocarboxylic acid compound concentration is less than 0.1 g/L, while on account of saturation there is no further advantage in exceeding 200 g/L.

The electroless plating solution of the present invention contains preferably a sulfurous acid compound as a stabilizer. Examples of this sulfurous acid compound include sulfurous acid and salts thereof such as alkali metal salts, alkaline earth metal salts, ammonium salts or the like. The concentration of the thiosulfuric acid compound in the plating solution is preferably from 0.1 to 200 g/L, and more preferably 1 to 100 g/L. The compound will have no effect as a stabilizer if the concentration is less than 0.1 g/L, while on account of saturation there is no further advantage in exceeding 200 g/L.

A phosphoric acid compound may also be added as needed as a pH buffer to the electroless gold plating solution of the present invention.

Examples of phosphoric acid compounds include phosphoric acid, pyrophosphoric acid or alkali metal, alkaline earth metal, and ammonium salts thereof, alkali metal dihydrogenphosphates, alkaline earth metal dihydrogenphosphates, ammonium dihydrogenphosphates, di-alkali metal hydrogenphosphates, di-alkaline earth metal hydrogenphosphates, and diammonium hydrogenphosphates. The concentration of the phosphoric acid compound in the plating solution is preferably from 0.1 to 200 g/L, and more preferably 1 to 100 g/L.

It is preferable to use one of the above-mentioned compounds as a pH buffer and adjust the pH of the gold plating solution of the present invention to be pH between 4 and 10, and more preferably a pH between 5 and 9.

The gold plating solution of the present invention is preferably used at a bath temperature of 10 to 95° C., and more preferably 50 to 85° C.

If the pH or bath temperature of the plating solution is outside the ranges given above, there will be problems such as slow plating rate or greater likelihood of bath decomposition.

The gold plating film achieved using the gold plating solution of the present invention, after a printed wiring board has been for instance nickel-plated to form an underlayer, has good solder adhesion and film adhesion because there is no non-uniform displacement on the underlying nickel plating film by gold. No non-uniform corrosion marks are seen either in the underlying nickel film after the gold plating film has been stripped away.

EXAMPLES

Preferred embodiments of the present invention will now be described through the following Examples and Comparative Examples.

Examples 1 to 5 and Comparative Examples 1 and 2

Plating solutions of the various compositions shown in Table 1 were prepared as the displacement electroless gold plating solutions. A copper-clad printed wiring board with a resist opening diameter of 0.6 mm was used as the material to be plated. Plating was performed according to the following process.

Acidic Degreasing (45° C., 5 min)

→ Soft etching (25° C., 2 min)

→ Acid washing (25° C., 1 min)

→ Activation (activator: KG-522, made by Nikko Metal Plating Co., Ltd.) (25° C., pH<1.0, 5 min)

→ Acid washing (25° C., 1 min)

→ Electroless nickel-phosphorus plating.

(plating solution: KG-530, made by Nikko Metal Plating Co., Ltd., grade: about 7% phosphorus in the plating film)

(88° C., pH 4.5., 30 min)

→ Displacement electroless gold plating (using plating solution and plating conditions listed in Table 1).

→ Reductive electroless gold plating (plating solution: KG-560, made by Nikko Metal Plating Co., Ltd.) (70° C., pH 5.0, 30 min)

(A water rinsing step lasting 1 minute is inserted between all steps except between acid washing → activation.)

The plated articles thus obtained were evaluated as follows. The state of corrosion of the underlying nickel plating film was observed at 2000 magnifications by SEM after the displacement electroless gold plating film had been stripped off with Aurum Stripper 710 (25° C., 0.5 min), a gold stripper made by Nikko Metal Plating Co., Ltd., then the presence of corrosion marks (pitting) was checked by visual observation.

Solder adhesive strength was measured using 0.6 mm diameter lead-free Sn-3.0Ag-0.5Cu solder balls as follows: after performing displacement electroless gold plating, the lead-free solder balls were thermally bonded to the gold plating film at a peak temperature of 250° C. in a reflow oven; the adhesive strength of the solder was then measured in accordance with a hot bump pull test method, using a series 4000 bond tester made by Dage Arctek Co., Ltd.

Film adhesion was evaluated as follows: the reductive electroless gold plating was performed after the displacement electroless gold plating, then the plating film was subjected to a tape peel test to visually check whether any film had peeled off. This peel test involved adhering a cellophane tape (Cellotape (registered trademark) made by Nichiban Co., Ltd.) to the plating film, then peeling the tape off and visually checking to see whether any plating film stuck to the tape.

The plating film thickness was measured with an SFT-3200 fluorescent X-ray film thickness gauge made by Seiko Denshi Kogyo Kabushiki Kaisha.

The evaluation results are given in Table 1.

TABLE 1-1

| | | Examples | | | |
|---|---|---|---|---|---|
| | | 1 | 2 | 3 | 4 |
| Bath components | Gold compound | Sodium gold sulfite: 1 g/L(gold) | Sodium chloroaurate: 1 g/L(gold) | Sodium gold, sulfite: 1 g/L(gold) | Sodium gold sulfite: 1 g/L(gold) |
| | Additive | Sodium hydrogensulfite: 5 g/L | Sodium hydrogensulfite: 20 g/L | Sodium hydrogensulfite: 50 g/L | Sodium hydrogensulfite: 100 g/L |
| | Additive | Sodium thiosulfate: 50 mg/L | — | Sodium thiosulfate: 100 mg/L | Sodium thiosulfate: 75 mg/L |
| | Stabilizer | Sodium sulfite: 10 g/L | Sodium sulfite: 20 g/L | Sodium sulfite: 10 g/L | Sodium sulfite: 5 g/L |
| | Complexing agent | Nitrilotriacetic acid: 10 g/L | Nitrilotriacetic acid: 10 g/L | Ethylenediamine-tetraacetic acid: 10 g/L | Ethylenediamine-tetraacetic acid: 5 g/L |
| | pH buffer | Disodium hydrogenphosphate: 20 g/L | Trisodium phosphate: 20 g/L | Sodium dihydrogenphosphate: 30 g/L | Sodium dihydrogenphosphate: 20 g/L |
| Plating conditions | pH | 7.5 | 7.5 | 7.5 | 7.5 |
| | Treatment temperature (° C.) | 80 | 80 | 80 | 80 |
| | Treatment time (min) | 20 | 20 | 20 | 20 |
| Evaluation results | Film thickness (μm) | 0.05 | 0.05 | 0.05 | 0.05 |
| | Pitting | None | None | None | None |
| | Solder adhesive strength | 2211 | 1955 | 2221 | 2248 |
| | Film adhesion | No peeling | No peeling | No peeling | No peeling |

Solder adhesive strength units: gf (n = 20)

TABLE 1-2

| | | Example | Comparative example | |
|---|---|---|---|---|
| | | 5 | 1 | 2 |
| Bath components | Gold compound | Sodium chloroaurate: 1 g/L(gold) | Sodium chloroaurate: 1 g/L(gold) | Potassium gold cyanide: 2 g/L(gold) |
| | Additive | Sodium hydrogensulfite: 200 g/L | — | — |
| | Additive | — | — | — |
| | Stabilizer | Sodium sulfite: 10 g/L | Sodium sulfite: 10 g/L | Citric acid: 30 g/L |
| | Complexing agent | Nitrilotriacetic acid: 20 g/L | Ethylenediaminetetra-acetic acid: 10 g/L | Ethylenediaminetetra-acetic acid: 10 g/L |
| | PH buffer | Disodium hydrogenphosphate: 30 g/L | Sodium dihydrogenphosphate: 30 g/L | — |
| Plating conditions | pH | 7.5 | 7.5 | 7.5 |
| | Treatment temperature (° C.) | 80 | 80 | 90 |
| | Treatment time (min) | 20 | 20 | 5 |
| Evaluation results | Film thickness (μm) | 0.05 | 0.05 | 0.05 |
| | Pitting | None | Yes | Yes |
| | Solder adhesive strength | 1972 | 1609 | 1506 |
| | Film adhesion | No peeling | Peeling | Peeling |

Solder adhesive strength units: gf (n = 20)

The results of Table 1 indicate that the films obtained using the electroless gold plating solution of the present invention exhibit no corrosion marks (pitting) of the underlying nickel plating film, while boasting excellent solder adhesion and film adhesion.

The invention claimed is:

1. A displacement electroless gold plating solution, characterized by containing a non-cyanide water-soluble gold compound and a hydrogensulfite compound.

2. The displacement electroless gold plating solution as claimed in claim 1, characterized by further containing a thiosulfuric acid compound.

3. The displacement electroless gold plating solution as claimed in claim 1, characterized by further containing an aminocarboxylic acid compound.

* * * * *